US011702331B2

(12) United States Patent
Mastro et al.

(10) Patent No.: US 11,702,331 B2
(45) Date of Patent: Jul. 18, 2023

(54) BEVERAGE DISPENSING MACHINES WITH DISPENSING VALVES

(71) Applicant: Marmon Foodservice Technologies, Inc., Osseo, MN (US)

(72) Inventors: Brian Mastro, Des Plaines, IL (US); Christopher F. Zemko, Elgin, IL (US); Mark Lytell, Glendale Heights, IL (US); David K. Njaastad, Palatine, IL (US); Craig Pavlich, Glen Ellyn, IL (US); Steven M. Shei, Fort Wayne, IN (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 16/865,143

(22) Filed: May 1, 2020

(65) Prior Publication Data

US 2020/0346917 A1 Nov. 5, 2020

Related U.S. Application Data

(60) Provisional application No. 62/842,912, filed on May 3, 2019, provisional application No. 62/884,856, filed on Aug. 9, 2019.

(51) Int. Cl.
*B67D 1/12* (2006.01)
*B67D 1/00* (2006.01)

(52) U.S. Cl.
CPC ..... *B67D 1/1218* (2013.01); *B67D 1/0035* (2013.01)

(58) Field of Classification Search
CPC ..... Y10T 137/7759; Y10T 137/7761; G05D 7/0635; B67D 1/0044; B67D 1/0048;
(Continued)

(56) References Cited

U.S. PATENT DOCUMENTS 3,591,051 A 7/1971 Mitchell et al.
3,643,688 A 2/1972 Meinert
(Continued)

FOREIGN PATENT DOCUMENTS

AU 2008296079 3/2009
EP 0253406 1/1988
(Continued)

OTHER PUBLICATIONS

International Search Report and the Written Opinion for PCT/US2020/031276, dated Jul. 30, 2020.
(Continued)

*Primary Examiner* — Charles P. Cheyney
(74) *Attorney, Agent, or Firm* — Andrus Intellectual Property Law, LLC

(57) ABSTRACT

A beverage dispensing machine includes a dispensing valve having a first flow path configured to dispense a first fluid and a second flow path configured to dispense a second fluid such that the first fluid and the second fluid mix downstream and form a mixed beverage. A flow control device regulates flow rate of the first fluid through the first flow path, and a shutoff valve selectively closes to stop flow of the first fluid through the first flow path. A sensor is configured to sense the flow rate of the first fluid, and a controller automatically controls the flow control device to adjust the flow rate of the first fluid and thereby obtain a desired fluid ratio of the mixed beverage.

8 Claims, 13 Drawing Sheets

(58) Field of Classification Search
CPC .. B67D 1/0888; B67D 1/0081; B67D 1/1218; B67D 1/0035; B67D 1/0037; B67D 1/1234; B67D 1/1277; B67D 1/1295; B67D 1/1285
USPC ..... 222/129.1–129.4, 1, 57, 71, 59
See application file for complete search history.

(56) References Cited

U.S. PATENT DOCUMENTS

| | | | | |
|---|---|---|---|---|
| 3,830,405 | A | 8/1974 | Jaeger | |
| 3,948,419 | A | 4/1976 | Polster | |
| 4,193,515 | A | 3/1980 | Purdy | |
| 4,226,344 | A | 10/1980 | Booth et al. | |
| 4,884,720 | A | 12/1989 | Whigham et al. | |
| 4,886,190 | A * | 12/1989 | Kirschner | B67D 1/1256 222/57 |
| 4,889,148 | A | 12/1989 | Smazik | |
| 4,890,774 | A * | 1/1990 | Poore | B67D 1/1213 141/102 |
| 4,953,754 | A | 9/1990 | Credle, Jr. | |
| 4,979,639 | A | 12/1990 | Hoover et al. | |
| 5,033,644 | A * | 7/1991 | Tentler | B67D 1/1295 222/63 |
| 5,060,824 | A | 10/1991 | Credle, Jr. | |
| 5,062,555 | A | 11/1991 | Whigham et al. | |
| 5,072,853 | A | 12/1991 | Shannon | |
| 5,129,434 | A | 7/1992 | Whigham et al. | |
| 5,156,301 | A | 10/1992 | Hassell et al. | |
| 5,181,631 | A | 1/1993 | Credle, Jr. | |
| 5,192,000 | A | 3/1993 | Wandrick et al. | |
| 5,316,179 | A | 5/1994 | Ioannides et al. | |
| 5,381,926 | A | 1/1995 | Credle, Jr. et al. | |
| 5,845,815 | A | 12/1998 | Vogel | |
| 5,868,279 | A * | 2/1999 | Powell | B67D 1/0855 222/129.1 |
| 6,129,112 | A | 10/2000 | Huthmann et al. | |
| 6,325,255 | B1 | 12/2001 | Lane et al. | |
| 6,328,181 | B1 | 12/2001 | Schroeder et al. | |
| 6,450,369 | B1 | 9/2002 | Heyes | |
| 6,845,886 | B2 | 1/2005 | Henry et al. | |
| 6,992,270 | B2 | 1/2006 | Lee et al. | |
| 7,077,290 | B2 | 7/2006 | Bethuy et al. | |
| 7,156,115 | B2 | 1/2007 | Everett et al. | |
| 7,156,259 | B2 | 1/2007 | Bethuy et al. | |
| 7,290,680 | B2 | 11/2007 | Henry et al. | |
| 8,087,544 | B2 * | 1/2012 | Elsom | B67D 1/0031 222/57 |
| 8,240,522 | B2 | 8/2012 | Newton et al. | |
| 8,485,220 | B2 | 7/2013 | Riano Gutierrez | |
| 8,839,993 | B2 | 9/2014 | Peirsman et al. | |
| 9,081,388 | B2 * | 7/2015 | Tanaka | G01F 25/0007 |
| 9,409,756 | B2 | 8/2016 | Piatnik et al. | |
| 9,499,390 | B1 * | 11/2016 | Newton | B67D 1/0021 |
| 9,511,987 | B2 | 12/2016 | Hayakawa et al. | |
| 10,100,622 | B2 | 10/2018 | Gonzalez | |
| 10,323,771 | B2 * | 6/2019 | Kunita | F16K 1/12 |
| 10,408,356 | B2 | 9/2019 | Mastro et al. | |
| 2002/0060226 | A1 | 5/2002 | Kameyama | |
| 2003/0015551 | A1 * | 1/2003 | Henry | B67D 1/005 222/129.3 |
| 2003/0097314 | A1 | 5/2003 | Crisp, III et al. | |
| 2004/0084475 | A1 | 5/2004 | Bethuy et al. | |
| 2004/0144423 | A1 | 7/2004 | Everett et al. | |
| 2004/0193326 | A1 | 9/2004 | Phillips et al. | |
| 2005/0145650 | A1 * | 7/2005 | Henry | B67D 1/1218 222/129.1 |
| 2008/0276991 | A1 | 11/2008 | Ziesel et al. | |
| 2008/0283550 | A1 | 11/2008 | Nighy et al. | |
| 2010/0005903 | A1 | 1/2010 | Beavis | |
| 2010/0127015 | A1 * | 5/2010 | Boyer | B67D 1/0036 700/285 |
| 2011/0315711 | A1 | 12/2011 | Hecht et al. | |
| 2012/0046785 | A1 * | 2/2012 | Deo | B67D 1/108 700/231 |
| 2013/0001249 | A1 | 1/2013 | Wiemer et al. | |
| 2016/0274595 | A1 * | 9/2016 | Ohmi | G01F 5/005 |
| 2017/0064977 | A1 | 3/2017 | Bischel | |
| 2017/0101298 | A1 * | 4/2017 | Renzi | B67D 1/0027 |
| 2017/0199529 | A1 * | 7/2017 | Ding | G01F 25/003 |
| 2017/0313566 | A1 * | 11/2017 | Makino | B67D 1/0028 |
| 2018/0135762 | A1 | 5/2018 | Mastro et al. | |
| 2018/0236414 | A1 | 8/2018 | Rudick | |
| 2018/0237280 | A1 | 8/2018 | Alberini et al. | |
| 2018/0354771 | A1 | 12/2018 | Wyatt et al. | |
| 2019/0112176 | A1 | 4/2019 | Sevcik et al. | |
| 2020/0003325 | A1 * | 1/2020 | Byle | F16K 1/526 |
| 2020/0010311 | A1 * | 1/2020 | Moore | B67D 1/0032 |

FOREIGN PATENT DOCUMENTS

| | | |
|---|---|---|
| EP | 0266202 | 5/1988 |
| EP | 2039649 | 3/2009 |
| EP | 1261545 | 7/2012 |
| WO | 2007070031 | 6/2007 |

OTHER PUBLICATIONS

Extended European Search Report for European Application No. 20801879.6, dated May 15, 2023.

* cited by examiner

BEVERAGE DISPENSING MACHINES WITH DISPENSING VALVES

CROSS-REFERENCE TO RELATED APPLICATIONS

The present disclosure is based on and claims priority to U.S. Provisional Patent Application Nos. 62/842,912 (filed May 3, 2019) and 62/884,856 (filed Aug. 9, 2019), the disclosures of which are incorporated herein by reference.

FIELD

The present disclosure relates to mixed beverage dispensing machines, and specifically to mixed beverage dispensing machines with beverage dispensing valves and flow controls.

BACKGROUND

The following U.S. Patents are incorporated herein by reference in entirety.

U.S. Pat. No. 5,845,815 discloses a piston based flow control for use in a high flow beverage dispensing valve. The piston includes a top perimeter edge structure that allows for continuity of liquid flow during high flow applications and particularly during the initiation of a high flow dispensing so as to eliminate chattering of the piston.

U.S. Pat. No. 7,290,680 discloses a post-mix beverage valve that provides for automatic, accurate beverage ratioing. A valve body can be assembled, and includes a water flow hard body, syrup body and common nozzle body. The water and syrup flow bodies define flow channels and include one end for connection to water and syrup respectively, and opposite ends for fluid connection to the nozzle body. The water flow channel includes a turbine flow sensor connected to a micro-controller determining the water flow rate. A stepper motor on the water body controls a rod in the flow channel in conjunction with a V-groove.

U.S. Pat. No. 10,408,356 discloses a valve that includes a housing defining a chamber with an inlet for receiving a fluid and an outlet for dispensing the fluid. A piston is located in the chamber and subjected to a fluid pressure exerted by the fluid received via the inlet. A plunger is received in the chamber, and the fluid pressure tends to move the piston towards the plunger. A spring tends to move the piston away from the plunger, against the fluid pressure. The plunger is axially registered in the chamber in discrete plunger positions, and each plunger position sets a discrete limit on axial movement of the piston thereby determining a predetermined flow characteristic of the fluid dispensed via the outlet.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a beverage dispensing machine includes a dispensing valve having a first flow path configured to dispense a first fluid and a second flow path configured to dispense a second fluid such that the first fluid and the second fluid mix downstream and form a mixed beverage. A flow control device regulates flow rate of the first fluid through the first flow path, and a shutoff valve selectively closes to stop flow of the first fluid through the first flow path. A sensor is configured to sense the flow rate of the first fluid, and a controller automatically controls the flow control device to adjust the flow rate of the first fluid and thereby obtain a desired fluid ratio of the mixed beverage.

In certain examples, a beverage dispensing system has a dispensing valve with a first flow path configured to dispense a first fluid and a second flow path configured to dispense a second fluid such that the first fluid and the second fluid mix downstream to form the mixed beverage. A first flow control device is configured to regulate flow rate of the first fluid, and a second flow control device is configured to regulate flow rate of the second fluid. A first sensor is configured to sense the flow rate of the first fluid and generate sensor data and a second sensor is configured to sense the flow rate of the second fluid and generate sensor data. A pair of shutoff valves selectively close to stop flow of the first fluid through the first flow path and the second fluid through the second flow path. A controller receives the sensor data from the first sensor and the second sensor, determines a sensed flow rate of the first fluid and a sensed flow rate of the second fluid, further determines a measured fluid ratio of the mixed beverage based on the sensed flow rate of the first fluid and the sensed flow rate of the second fluid, and compares the measured fluid ratio to a desired fluid ratio, wherein the controller further controls the flow control device to thereby change the flow rate of the first fluid and the flow rate of the second fluid such that the measured fluid ratio equals the desired fluid ratio.

In certain examples, a method for dispensing a beverage from a beverage dispensing machine includes dispensing a first fluid from a first flow path and a second fluid from a second flow path to thereby form a mixed beverage, regulating, with a flow control device, flow rate of the first fluid through the first flow path, and selectively closing a shutoff valve to thereby stop dispense of the first fluid from the first flow path. The method also includes sensing the flow rate of the first fluid through the first flow path with a first sensor that generates sensor data, determining a sensed flow rate of the first fluid based on the sensor data from the first sensor, determining a measured fluid ratio based on the sensed flow rate of the first fluid, comparing the measured fluid ratio to a desired fluid ratio, and controlling the flow control device to thereby change the flow rate of the first fluid such that the measured fluid ratio matches the desired fluid ratio.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
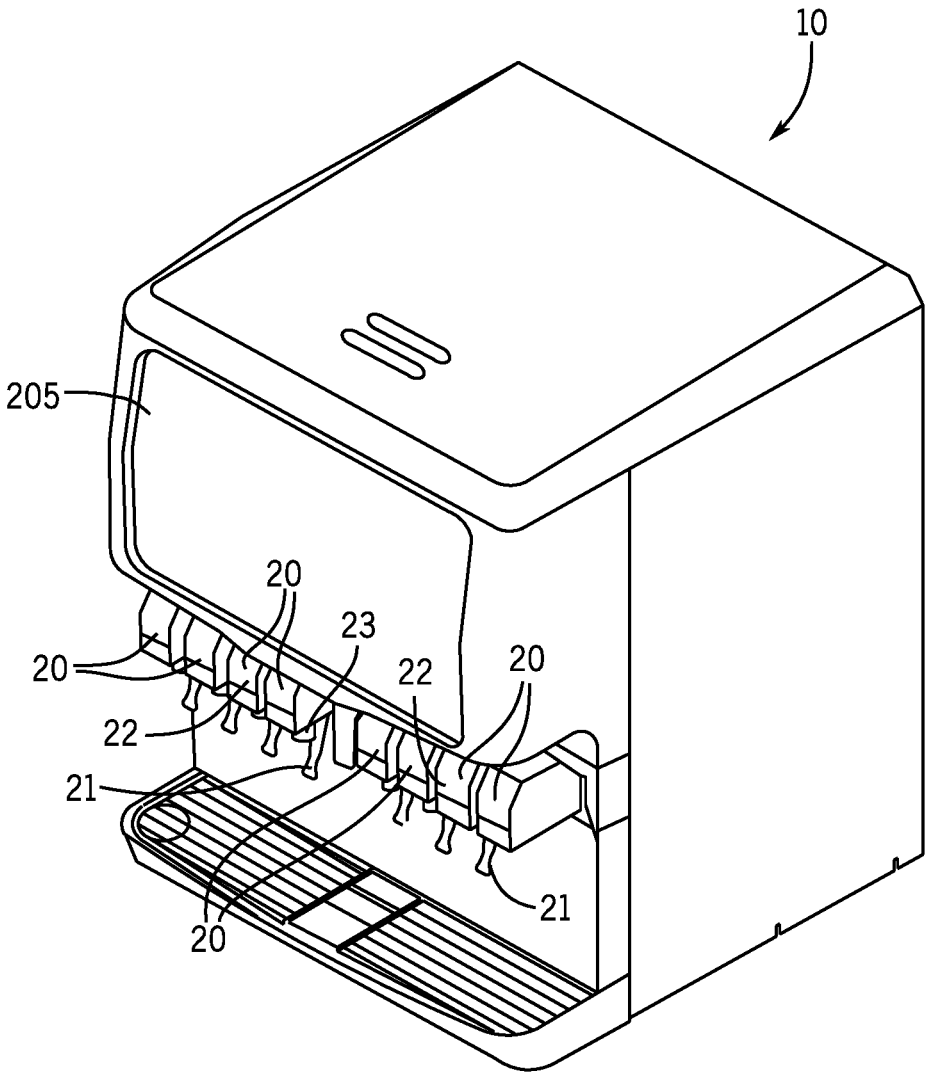
FIG. 1 is a perspective view of an example beverage dispensing machine of the present disclosure.

Conventional beverage dispensing machines are commonly used in the food service industry for dispensing post-mix beverages to an operator. The dispensing machine includes one or more dispensing valves that each receive at least two independent pressurized beverage components, such as a first fluid (e.g., base fluid, carbonated water) and a second fluid (e.g., concentrate, soda flavor syrup), and dispense the beverage components to form a mixed beverage. The valve independently controls the flow rates (e.g., ounces per second) of the beverage components such that the mixed beverage is formed with a desired fluid ratio (e.g., 3:1, 4:1, 5:1) and at a desired flow rate (e.g., 1.2 oz/sec). For example, to form a mixed beverage with a 5:1 fluid ratio, the valve dispenses the first fluid at 1.0 oz/sec and second fluid at 0.2 oz/sec. Certain conventional beverage dispensing valves include manually adjustable flow controls that are adjusted by technicians to change the flow rate of the first fluid and/or the second fluid, respectively. Reference is made to above-incorporated U.S. Pat. No. 5,845,815 for further description of the components and operation of a conventional manually adjustable flow control.

The present inventors have determined that during operation of conventional dispensing valves, there is often a small time delay (e.g., 0.50 seconds) between the time the valve is activated (e.g., by pushing an operator interface button or a mechanical lever arm) and the time the mixed beverage is dispensed from the nozzle. The inventors found that this time delay can confuse the operator into thinking that the valve is not operating correctly, and thus, the operator may push harder on the button or the lever arm thereby damaging the button or the lever arm. Thus, the inventors have realized that there is a need to minimize time delay and prevent damage to the valve.

In addition, the present inventors have determined that conventional dispensing valves may rapidly open and/or close, which thereby increases the turbulence of the beverage components (e.g., the beverage component dispenses in a highly turbulent state). The present inventors have recognized that turbulence in the beverage components increases undesirable foaming of the mixed beverage in the cup and increases the rate at which the gas (e.g., carbon dioxide) "breaks out" of solution. Thus, the inventors have realized that there is a need to reduce the turbulence of the beverage components.

Furthermore, the present inventors have realized that conventional flow controls are time-consuming to set up (e.g., a technician must engage a screw head to adjust the flow controls) and these flow controls can be tampered with to alter the fluid ratio of the mixed beverage. Furthermore, it is often difficult to verify that the conventional flow controls are properly set up and further verify that the mixed beverage is dispensing at the desired fluid ratio and the desired flow rate. Also, certain conventional flow controls do not automatically adjust the flow rate as the fluid characteristics of the beverage components change. For example, an unexpected increase to the temperature of the beverage components may change fluid characteristics (e.g., viscosity) of the beverage components and thereby alter the flow rate of the beverage components (e.g., increasing temperature may increase viscosity thereby causing the flow rate of the beverage components to increase). Thus, the present inventors have determined that there is a need to monitor and automatically adjust the flow rate of the beverage components during operation of the valve.

Accordingly, the present inventors have endeavored to provide improved beverage dispensing machines that overcome the above-noted problems associated with conventional dispensing valves and conventional flow controls. The present disclosure is a result of these efforts.

FIG. 1 is an example post-mix beverage machine 10 of the present disclosure. The beverage machine 10 cools (e.g., electrically or ice-cooled) and dispenses different types of mixed beverages to the operator. The example machine 10 depicted in FIG. 1 includes eight beverage dispensing valves 20 that each dispense a mixed beverage to an operator. Note that the number of dispensing valves 20 can vary. Each dispensing valve 20 includes an operable mechanical lever arm 21 that can be engaged by the operator to thereby activate or open the dispensing valve 20 and dispense the mixed beverage via a nozzle 23. In other examples, the dispensing valves 20 are operated via an operator input device 205 (e.g., touchscreen, mechanical push buttons) on the machine 10 or a housing 22 of each dispensing valve 20.

Figure 2:
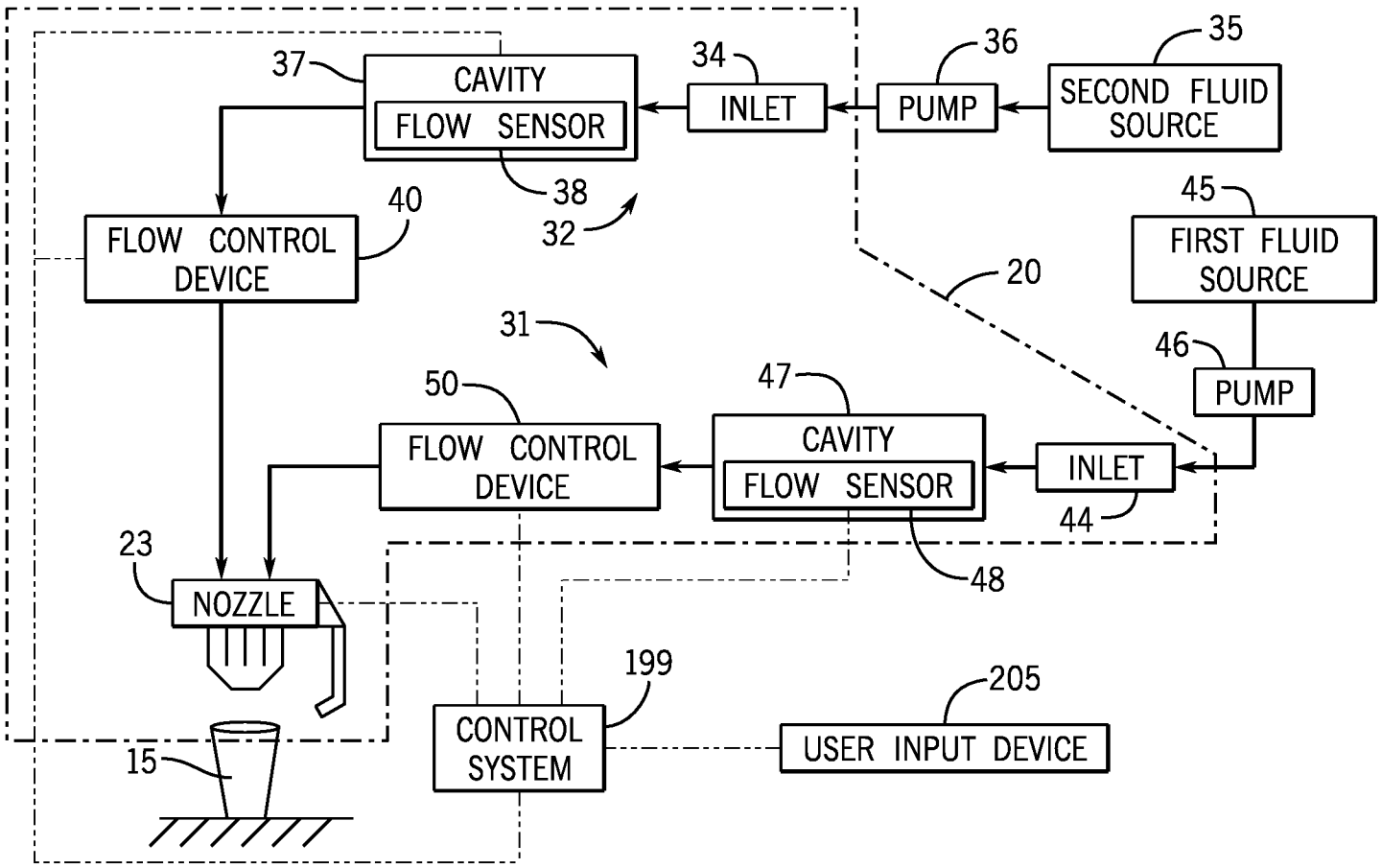
FIG. 2 is a schematic view of an example beverage dispensing machine of the present disclosure.

FIG. 2 depicts a schematic view of an example dispensing valve 20 of the present disclosure. The valve 20 includes a first flow path 31 through which the first fluid (e.g., carbonated water) flows and a second flow path 32 through which the second fluid (e.g., concentrate) flows. The first flow path 31 has an inlet 44 that receives the first fluid from a first fluid source 45. The first fluid may be pressurized by a pump 46 or conveyed from a pressurized tank (not shown). The first fluid flows through the inlet 44 downstream into a cavity 47 in which a flow sensor 48 is positioned. When the valve 20 is open, the flow sensor 48 senses the flow rate of the first fluid and generates sensor data. A controller 200 (FIG. 6) receives the sensor data and further processes the sensor data as described herein. The type of flow sensor can vary (e.g., oval gear, turbine wheel, single or differential pressure transducer, ultrasonic, electromagnetic, thermal mass), and an example of a conventional flow sensor that may utilized in the valve 20 is manufactured by Digmesa (model/part #FHK and EPI). The flow sensor 48 is upstream from a first flow control device 50 (described herein), and the first flow control device 50 receives the first fluid and regulates or controls the flow rate of the first fluid flowing through the first flow path 31. That is, the first flow control device 50 controls the flow rate of the first fluid such that the first fluid dispenses to the nozzle 23 at a predetermined flow rate (e.g., 1.0 oz/sec). Note that in certain examples the cavity 47 and/or the flow sensor 48 are downstream from the first flow control device 50.

The second flow path 32 has an inlet 34 that receives the second fluid from a second fluid source 35. The second fluid may be pressurized by a pump 36 or conveyed from a pressurized tank (not shown). The second fluid flows through the inlet 34 downstream into a cavity 37 in which a flow sensor 38 is positioned. When the valve 20 is open, the flow sensor 38 senses the flow rate of the second fluid and generates sensor data. A controller 200 (FIG. 6) receives the sensor data and further processes the sensor data as described herein. The flow sensor 38 is upstream from a second flow control device 40 (described herein) that receives the second fluid and regulates or controls the flow rate of the second fluid flowing through the second flow path 32. That is, the second flow control device 40 controls the flow rate of the second fluid such that the second fluid dispenses to the nozzle 23 at a predetermined flow rate (e.g., 0.2 oz/sec). Accordingly, the first fluid and the second fluid dispense from the flow paths 31, 32, respectively, and mix downstream to form the mixed beverage at the desired fluid ratio (e.g., 5:1) and the desired flow rate (e.g., 1.2 oz/sec). Note that in other examples, certain features or components in the flow paths 31, 32 described above may be excluded.

The type of flow control devices 40, 50 utilized in the valve 20 can vary. For example each of the flow control devices 40, 50 can be a needle valve with a stepper motor, a ceramic piston flow control, a rotary ceramic valve, or a fixed volume displacement device.

Figure 3:
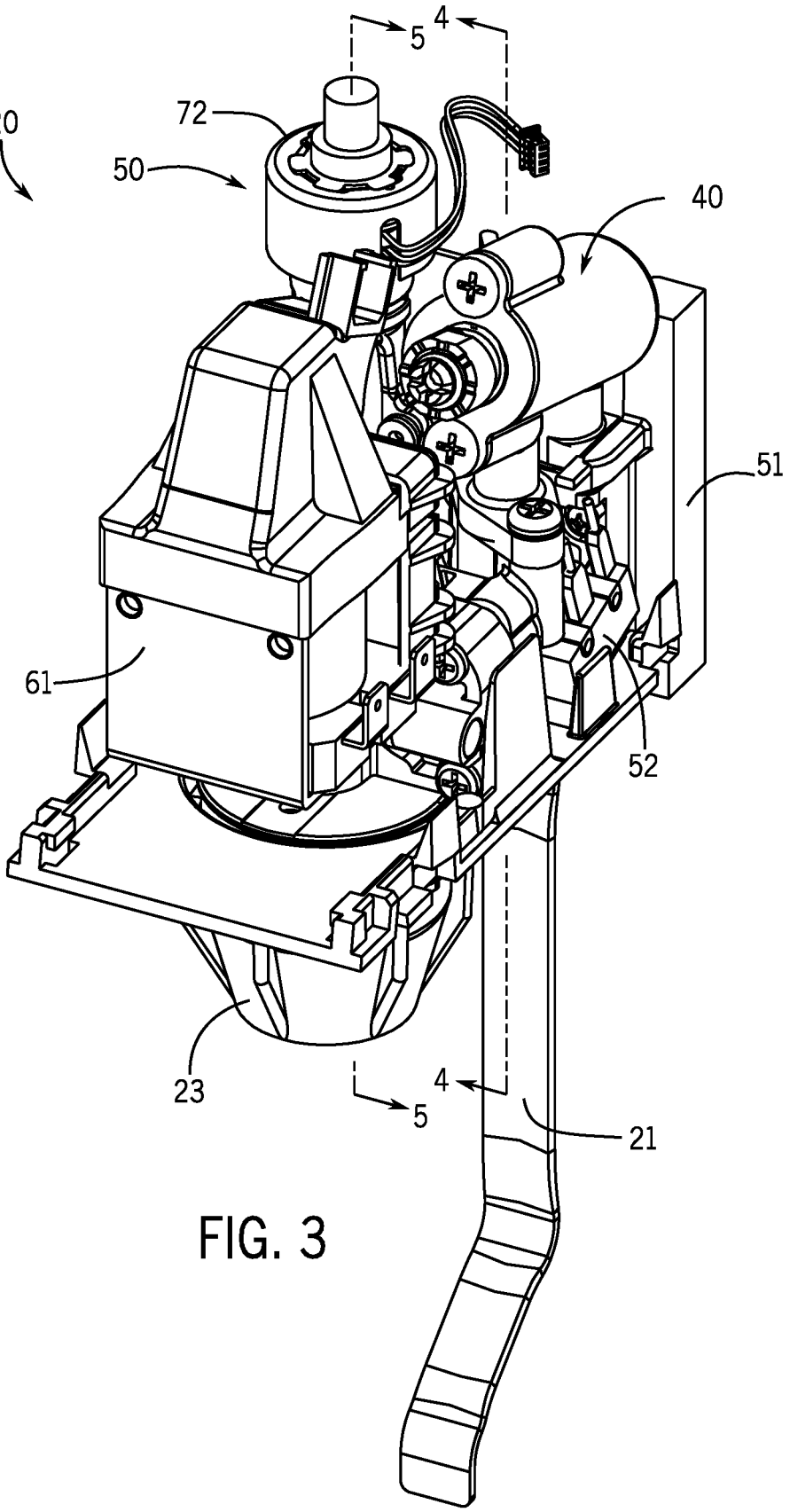
FIG. 3 is a perspective view of an example dispensing valve of the present disclosure.
Figure 4:
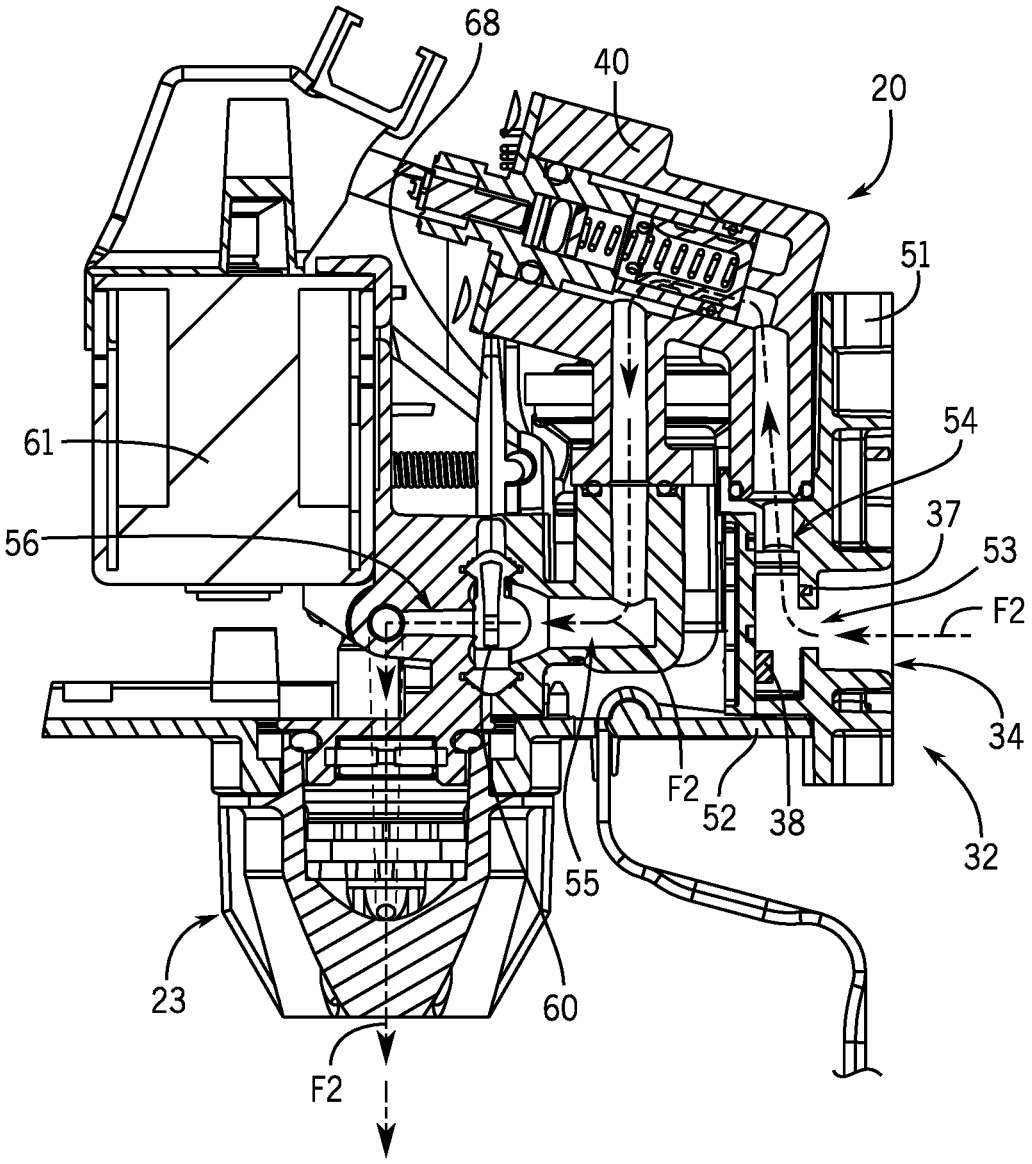
FIG. 4 is a cross-sectional view of the dispensing valve of FIG. 3 along line 4-4 on FIG. 3.
Figure 5:
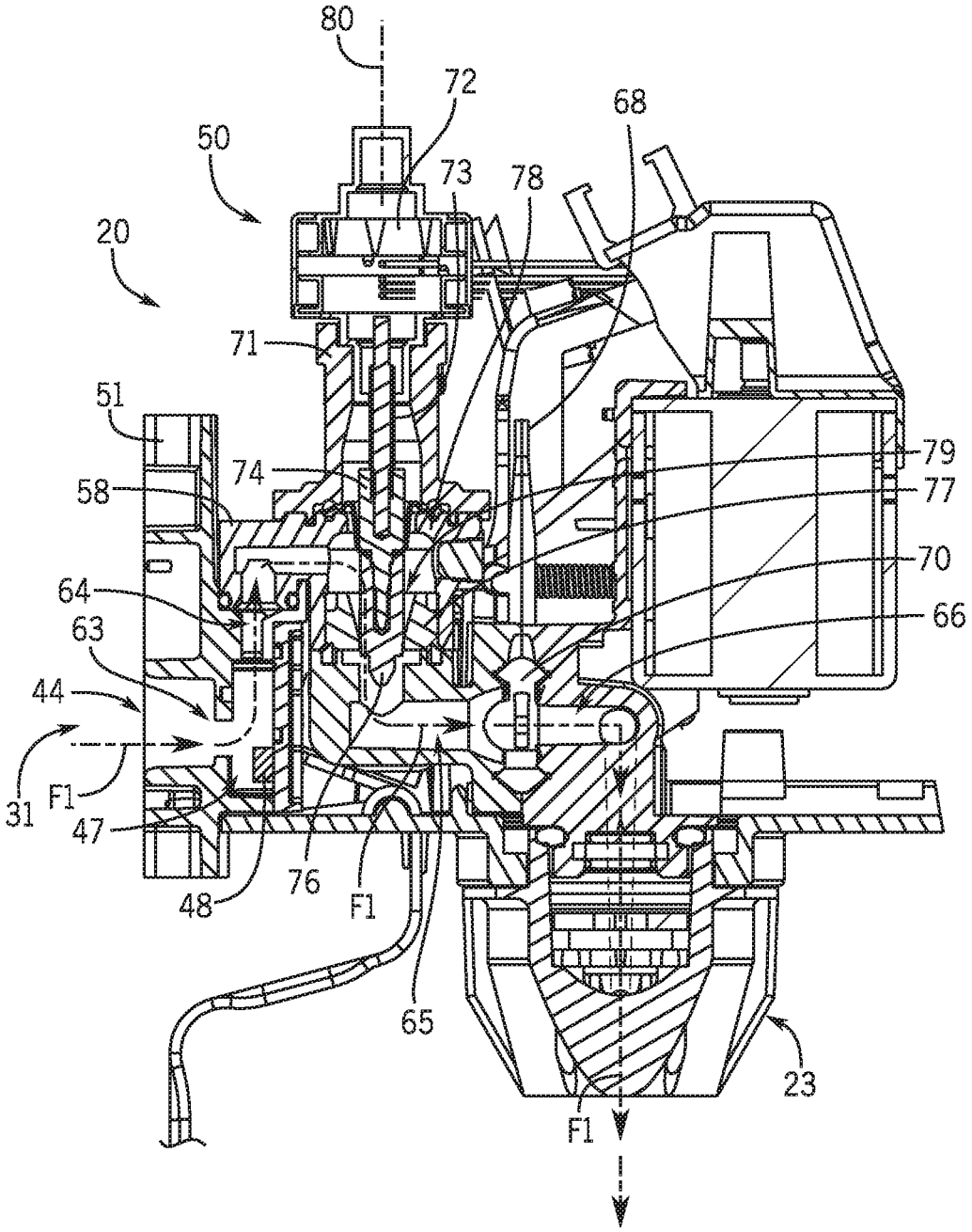
FIG. 5 is a cross-sectional view of the dispensing valve of FIG. 3 along line 5-5 on FIG. 3.

Referring now to FIGS. 3-5, an example dispensing valve 20 of the present disclosure is depicted in greater detail. FIG. 4 is a section view and depicts the second flow path 32 of the valve 20 through which the second fluid flows (note the second fluid is depicted by dashed line F2). The valve 20 has a backblock 51 in which the inlet 34 is defined, and a first body 52 is removably coupled to the backblock 51. Note that in other examples the backblock 51 and the first body 52 are integrally formed with each other.

The first body 52 has a first bore 53 that extends from the inlet 34 to the cavity 37. The size and/or shape of the cavity 37 corresponds to the type of flow sensor 38. A second bore 54 extends from the cavity 37 to the second flow control device 40. In this example, the second flow control device 40 is a manually operated piston flow control. The second fluid flows through the second flow control device 40 to a third bore 55 containing a shutoff valve 60. A solenoid 61 operates the shutoff valve 60 and selectively opens the shutoff valve 60 to permit the second fluid to flow through a fourth bore 56 to the nozzle 23. When the shutoff valve 60 closes, the second fluid is retained upstream in the third bore 55, the second flow control device 40, the second bore 54, the cavity 37, and the first bore 53.

FIG. 5 depicts the first flow path 31 of the valve 20 through which the first fluid flows (note the first fluid is depicted by dashed line F1). The backblock 51 defines the inlet 44, and the valve 20 has a second body 58. The second body 58 has a first bore 63 that extends from the inlet 44 to the cavity 47. The size and/or shape of the cavity 47 corresponds to the flow sensor 48. A second bore 64 extends from the cavity 47 to the first flow control device 50. In this example, the first flow control device 50 is a needle valve. The first fluid flows through the first flow control device 50 to a third bore 65 in which a shutoff valve 70 is positioned. The solenoid 61 operates the shutoff valve 70 and selectively opens the shutoff valve 70 to permit the first fluid to flow through a fourth bore 66 to the nozzle 23. When the shutoff valve 70 closes, the first fluid is retained upstream in the third bore 65, the first flow control device 50, the second bore 64, the cavity 47, and the first bore 63.

An actuating arm 68 (FIGS. 4-5) is coupled to the shutoff valves 60, 70 and is configured to pivot when the solenoid 61 energizes to thereby open and close the shutoff valves 60, 70. For example, when the solenoid 61 energizes, the solenoid 61 pivots the actuating arm 68 in a first direction such that the shutoff valves 60, 70 open. When the solenoid 61 de-energizes, the actuating arm 68 pivots, due to a biasing member (not shown; e.g., a spring), in a second direction opposite the first direction such that the shutoff valves 60, 70 close. Each shutoff valve 60, 70 has a seal (not shown) in the flow paths 31, 32, respectively.

Referring to FIG. 5, and as noted above, the first flow control device 50 in the illustrated example is a needle valve. The needle valve has a housing 71 (FIG. 5) coupled to the second body 58. An actuator 72 (e.g., a stepper motor) is connected to the housing 71 and is further operably connected to a shaft 73 that is in the housing 71. A plunger 74 and a needle 76 are coupled to the shaft 73 such that as the actuator 72 axially (see axis 80 in FIG. 5) moves the shaft 73, the plunger 74 and the needle 76 axially move with the shaft 73. A flexible seal 78 extends between the housing 71 and the plunger 74, and the flexible seal 78 maintains a fluid tight seal between the housing 71 and the plunger 74 as the plunger 74 and the needle 76 axially move within the housing 71. Accordingly, the needle 76 moves relative to a valve block 77 in first flow path. The valve block 77 defines a frustoconical-shaped channel 79 in which the needle 76 moves to thereby vary a gap or distance between the needle 76 and the valve block 77.

Figure 6:
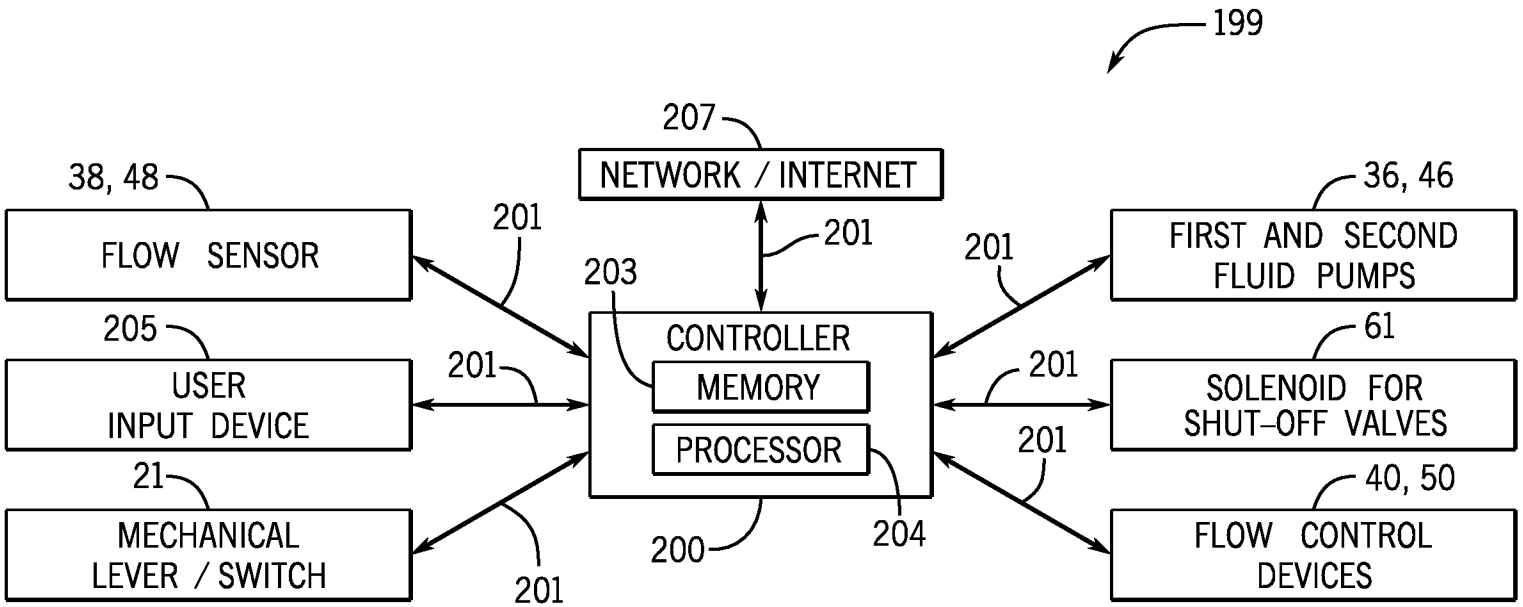
FIG. 6 is a schematic view of an example control system of the present disclosure.

Referring now to FIG. 6, the dispensing machine 10 includes a control system 199 having the controller 200 for controlling operation of the dispensing valve 20. For example, the controller 200 controls (e.g., opens) the valve 20 based on signals from the operator input device 205 and/or the lever arm 21 (see also FIG. 1). The controller 200 further controls the first flow control device 50 based on sensor data from least one of the flow sensors 38, 48 to thereby adjust and/or maintain the flow rate of the first fluid at a predetermined flow rate and/or the flow rate of the second fluid at a predetermined flow rate such that a mixed beverage dispenses from the valve 20 at a desired flow rate (e.g., 1.2 ounces per second) and a desired fluid ratio (e.g., 5:1). The control functions of the control system 199 and/or the controller 200 are described herein below.

The controller 200 has a processor 204 and a memory 203. The controller 200 can be located anywhere in the control system 199, and the controller 200 is in communication with the various components of the beverage machine 10 and/or the valve 20 (FIG. 1) via wired and/or wireless communication links 201. In certain examples, the system 199 has more than one controller 200. The controller 200 is connected to the operator input device 205 (e.g., touchscreen panel) and/or an internet/network 207 such that the predetermined flow rates of the first and second fluids, the desired flow rate of the mixed beverage, and/or the desired fluid ratio of the mixed beverage can be inputted into the control system 199. In addition, other data, such as the type of mixed beverage that dispenses from the valve 20 (e.g., cola soda, white soda, juice, mixed beverage with sugar, mixed beverage without sugar, carbonated, non-carbonated) and the type of the first fluid (e.g., still water, carbonated water), can be inputted into the control system 199 via the operator input device 205.

An example method for operating and controlling the valve 20 depicted in FIGS. 3-5 is described herein below with reference to FIG. 7. As noted above, in this example the first flow control device 50 that controls the flow rate of the first fluid (e.g., carbonated water) is a needle valve and the second flow control device 40 that controls the flow rate of the second fluid (e.g., syrup concentrate) is a manually operated piston flow control.

Figure 7:
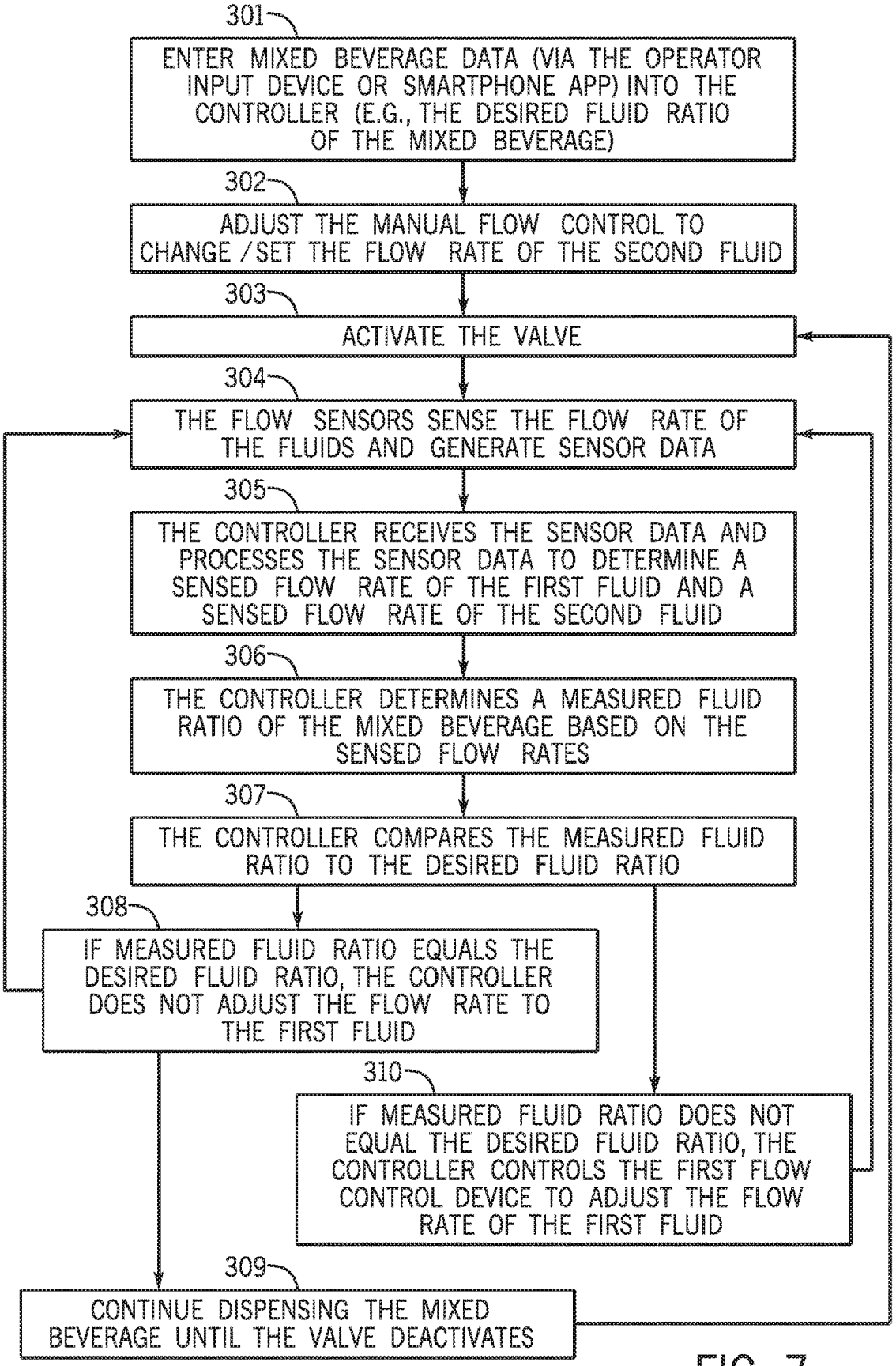
FIG. 7 is an example method of the present disclosure.

The method begins, as depicted at 301 in FIG. 7, with the technician entering input data via the operator input device 205 into the controller 200 (FIG. 6). The input data corresponds to desired characteristics or features of the mixed beverage to be dispensed from the valve 20. For example, the input data includes the desired fluid ratio of the mixed beverage (e.g., 5:1).

The technician also manually adjusts an operable feature of the second flow control device 40 (FIG. 4) to thereby set the flow rate of the second fluid to a predetermined flow rate (e.g., 0.3 oz/sec), as depicted at 302. In one example, the operable feature of the second flow control device 40 is a screw head that is rotatable to increase or decrease the flow rate of the second fluid (e.g., rotating the screw head in a clockwise direction increases the flow rate of the second fluid)

The example method depicted in FIG. 7 continues, depicted at 303, when the technician or an operator activates the valve 20 and the valve 20 dispenses the mixed beverage. As noted above, activation of the valve 20 can occur when the operator pivots the mechanical lever arm 21 (FIG. 1), presses an operator interface button (not shown), or enters a mixed beverage selection via the operator input device 205 (FIG. 6). When the valve 20 activates, the solenoid 61 energizes and thereby pivots the actuating arm 68 to open the shutoff valves 60, 70 (FIGS. 4-5). Accordingly, the first fluid and the second fluid flow through the valve 20.

As the first and the second fluids flow through the valve 20, the flow sensors 38, 48 (FIGS. 4-5) sense the flow rates of the first fluid and the second fluid, respectively, and generate sensor data corresponding to flow rates of the first fluid and the second fluid, as depicted at 304. Specifically, the flow sensor 48 in the first flow path 31 (FIG. 5) senses the flow rate of the first fluid and generates sensor data corresponding to the flow rate of the first fluid. Similarly, the flow sensor 38 in the second flow path 32 (FIG. 4) senses the flow rate of the second fluid and generates sensor data corresponding to the flow rate of the second fluid.

As depicted at 305, the controller 200 (FIG. 6) receives the sensor data from the flow sensors 38, 48 (FIGS. 4-5) and processes the sensor data to determine a sensed flow rate of the first fluid and a sensed flow rate of the second fluid. The controller 200, depicted at 306, determines a measured fluid ratio (e.g., 5:1, 4:1) of the mixed beverage that dispenses from the valve 20 based on the sensed flow rates of the first fluid and the second fluid. The controller 200 determines the measured fluid ratio by comparing the sensed flow rates of the first fluid and the second fluid to values in a look-up table stored on the memory 203 (FIG. 6). In other examples, the controller 200 determines the measured fluid ratio with on one or more software modules or algorithms stored on the memory 203 (FIG. 6).

As shown at 307, the controller 200 then compares the measured fluid ratio to the desired fluid ratio that was entered into the controller 200 by the technician (as depicted at 301). If the controller 200 determines that the measured fluid ratio matches or equals the desired fluid ratio (e.g., the measured fluid ratio is 5:1 and the desired fluid ratio is 5:1), the controller 200 does not adjust the flow rate of the first fluid, as depicted at 308 (e.g., the controller 200 does not control or operate the first flow control device 50 to thereby adjust the flow rate of the first fluid). The method then returns to 304 such that the controller 200 continuously monitors the measured fluid ratio (e.g., a continuous feedback loop). The method continues until the valve 20 deactivates and the shutoff valves 60, 70 (FIGS. 4-5) close, as depicted at 309, such that the mixed beverage does not dispense from the valve 20. Note that method depicted in FIG. 7 restarts at 303 when the valve 20 re-activates.

However, if the controller 200 determines that the measured fluid ratio does not equal the desired fluid ratio (e.g., the measured fluid ratio is 10:1 and the desired fluid ratio is 5:1), the controller 200 controls or operates the first flow control device 50 (FIG. 5) to adjust the flow rate of the first fluid, as depicted at 310. In this example, the controller 200 controls the actuator 72 (FIG. 5) which moves the needle 76 relative to the valve block 77 (FIG. 5) to adjust the flow rate of the first fluid. Moving the needle 76 toward the valve block 77 decreases the flow rate of the first fluid, and moving the needle 76 away from the valve block 77 increases the flow rate of the first fluid. The method then returns to 304 such that the controller 200 continuously determines the measured fluid ratio and further adjusts the flow rate of the first fluid (as necessary) until the measured fluid ratio equals the desired fluid ratio, as depicted at 308.

In one specific example, the flow sensor 48 in the first flow path 31 (FIG. 5) senses the flow rate of the first fluid (e.g., carbonated water) and the controller 200 (FIG. 6) determines that the sensed flow rate of the first fluid is 3.0 oz/sec. The flow sensor 38 in the second flow path 32 (FIG. 4) senses the flow rate of the second fluid (e.g., syrup concentrate) and the controller 200 (FIG. 6) determines that the sensed flow rate of the second fluid is 0.3 oz/sec. The controller 200 then determines the measured fluid ratio to be 10:1 based on the sensed flow rates and further compares the measured fluid ratio to the desired fluid ratio. In this example, the desired flow rate is 5:1. Accordingly, the measured fluid ratio (10:1) does not equal the desired fluid ratio (5:1) and the controller 200 (FIG. 6) controls the first flow control device 50 (FIG. 5) to thereby reduce the flow rate of the first fluid to 1.5 oz/sec. Thus, the measured fluid ratio will be 5:1. Note that in this example, the flow rate of the mixed beverage dispensing from the valve 20 is 1.8 oz/sec when the measure fluid ratio is 5:1. In certain examples, if the measured flow rate of the mixed beverage dispensing from the valve 20 is less than a desired flow rate (e.g., 3.0 oz/sec), the controller 200 alerts the operator via the operator input device 205.

Figure 8:
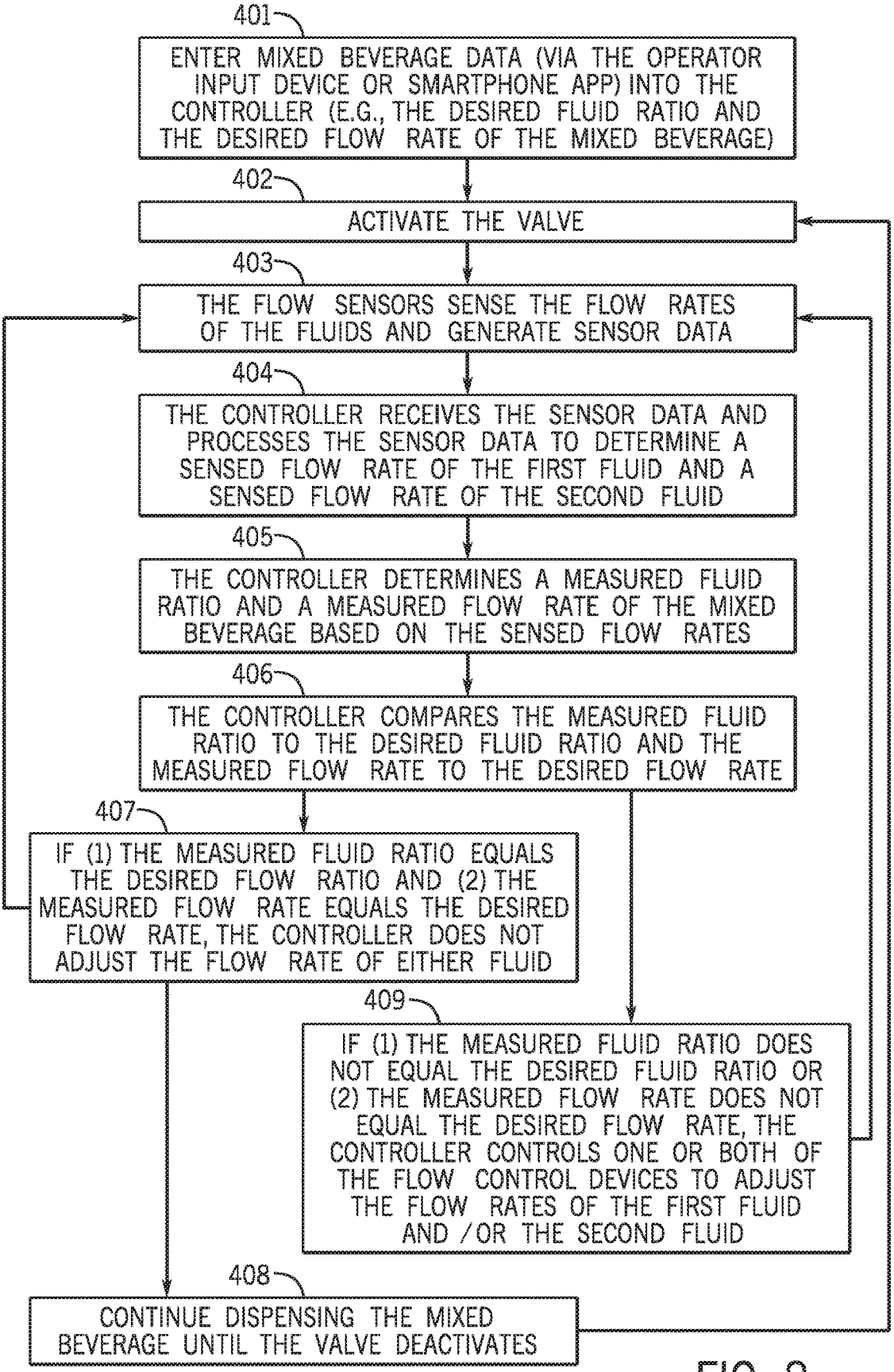
FIG. 8 is another example method of the present disclosure.

FIG. 8 depicts another method for operating and controlling an example valve 20 of the present disclosure. In this example, the first flow control device 50 and the second flow control device 40 are both needle valves. As depicted at 401, the method begins with the technician entering input data via the operator input device 205 into the controller 200 (FIG. 6). The input data includes characteristics or features of the mixed beverage to be dispensed from the valve 20, and the input data can include the desired fluid ratio of the mixed beverage (e.g., 5:1) and the desired flow rate of the mixed beverage (e.g., 3.0 oz/sec).

In certain examples, the technician selects the desired fluid ratio and/or the desired flow rate from a list of fluid ratios and/or flow rates stored on the memory 203 of the controller 200 (FIG. 6). In other examples, the technician selects the type of mixed beverage that will dispense from valve 20 from a list of mixed beverages stored on the memory 203 of the controller 200 (FIG. 6). Each type of mixed beverage in the list has a corresponding desired fluid ratio and desired flow rate (e.g., selecting a cola soda from the stored list and the cola soda has a 5:1 fluid ratio and a 3.0 oz/sec flow rate). Still further, in certain examples the desired flow rate and the desired fluid ratio can be entered into the controller 200 (FIG. 6) via remote devices (e.g., personal computer, point-of-sale system, smartphone app) via the internet/network 207 (FIG. 6).

The example method depicted in FIG. 8 continues, depicted at 402, when the technician or an operator activates the valve 20 such that the valve 20 dispenses the mixed beverage. As the first and the second fluids flow through the valve 20, the flow sensors 38, 48 (FIGS. 4-5) sense the flow rates of the first fluid and the second fluid, respectively, and generate sensor data corresponding to flow rates of the first fluid and the second fluid, as depicted at 403. The controller 200 (FIG. 6) receives the sensor data from the flow sensors 38, 48 and processes the sensor data to determine a sensed flow rate of the first fluid and a sensed flow rate of the second fluid, depicted at 404. The controller 200, depicted at 405, determines a measured fluid ratio (e.g., 5:1, 4:1) of the mixed beverage dispensing from the valve 20 based on the sensed flow rates of the first fluid and the second fluid. The controller 200 determines the measured fluid ratio by comparing the sensed flow rates of the first fluid and the second fluid to values in a look-up table stored on the memory 203 (FIG. 6). In other examples, the controller 200 determines the measured fluid ratio with on one or more software modules or algorithms stored on the memory 203 (FIG. 6).

The controller 200 also determines a measured flow rate (e.g., 3.0 oz/sec, 2.5 oz/sec) of the mixed beverage dispensing from the valve 20 based on the sensed flow rates of the first fluid and the second fluid. The controller 200 determines the measured flow rate by comparing the sensor data to values in a look-up table stored on the memory 203 (FIG. 6). In other examples, the controller 200 determines the measured flow rate with on one or more software modules or algorithms stored on the memory 203 (FIG. 6).

As shown at 406, the controller 200 then compares both the measured fluid ratio to the desired fluid ratio and the measured flow rate to the desired flow rate. If the controller 200 determines that the measured fluid ratio matches or equals the desired fluid ratio (e.g., the measured fluid ratio is 5:1 and the desired fluid ratio is 5:1) and the measured flow rate matches or equals the desired flow rate (e.g., the measured flow rate is 3.0 oz/sec and the desired flow rate is 3.0 oz/sec), the controller 200 does not adjust the flow rate of the first fluid or the second fluid, as depicted at 407. The method then returns to 403 such that the controller 200 continuously monitors the measured fluid ratio and the measured flow rate of the mixed beverage. The method continues until the valve 20 de-activates and the shutoff valves 60, 70 (FIGS. 4-5) close, as depicted at 408, such that the mixed beverage does not dispense from the valve 20. Note that after the valve 20 deactivates and then re-activates a period of time later to dispense an additional mixed beverage to the operator, the example method depicted in FIG. 8 restarts at 402.

However, as depicted at 409, if the controller 200 determines that the measured fluid ratio does not equal the desired fluid ratio (e.g., the measured fluid ratio is 10:1 or 4:1 and the desired fluid ratio is 5:1) or the measured flow rate does not equal the desired flow rate (e.g., the measured flow rate is 2.5 oz/sec and the desired flow rate is 3.0 oz/sec), the controller 200 controls or operates one or both of the flow control devices 40, 50 (FIGS. 4-5) to adjust the flow rates of the first fluid and/or the second fluid. The controller 200 may control the flow control devices 40, 50 in accordance to software module and/or algorithms stored on the memory 203 (FIG. 6) to efficiency adjust the flow rates of the first fluid and/or the second fluid. In certain examples, the controller 200 controls or operates one or both of the flow control devices 40, 50 (FIGS. 4-5) to adjust the flow rates of the first fluid and/or the second fluid until the measured fluid ratio equals the desired fluid ratio and the measured flow rate equals the desired flow rate.

The method returns to 403 such that the controller 200 continuously determines the measured fluid ratio and the measured flow rate and continuously adjusts, if necessary, the flow rate of the first fluid and/or the flow rate of the second fluid until the measured fluid ratio equals the desired fluid ratio and the measured flow rate equals the desired flow rate, as depicted at 407.

Note that the manner in which the controller 200 controls the flow control devices 40, 50 (FIG. 2) to adjust the flow rates of the first fluid and/or the second fluid may vary. In one example, the controller 200 controls the flow control devices 40, 50 (FIG. 2) in such a way that the measured fluid ratio is adjusted to equal the desired fluid ratio at the same time the measured flow rate is adjusted to equal the desired flow rate. In another example, the controller 200 prioritizes controlling the flow control devices 40, 50 (FIGS. 4-5) to first change the measured fluid ratio to the desired fluid ratio before controlling the flow control devices 40, 50 (FIGS. 4-5) to change the measured flow rate to the desired flow rate. In this example, the controller 200 ensures that the mixed beverage dispenses from the valve 20 at the desired fluid ratio. If the mixed beverage dispenses at the desired fluid ratio but at flow rate different than the desired flow rate, the controller 200 may alert the operator that the valve 20 should be inspected.

In one specific example, the flow sensor 48 in the first flow path 31 (FIG. 2) senses the flow rate of the first fluid (e.g., carbonated water), and the controller 200 (FIG. 6) determines that the sensed flow rate of the first fluid is 3.0 oz/sec. The flow sensor 38 in the second flow path 32 (FIG. 2) senses the flow rate of the second fluid (e.g., syrup concentrate), and the controller 200 (FIG. 6) determines that the sensed flow rate of the second fluid is 0.3 oz/sec. The controller 200 then determines the measured fluid ratio to be 10:1 based on the sensed flow rates and further compares the measured fluid ratio to the desired fluid ratio (5:1 in this example). Accordingly, the measured fluid ratio (10:1) does not equal the desired fluid ratio (5:1) and the controller 200 (FIG. 6) controls the flow control devices 40, 50 (FIG. 4-5) to adjust the flow rates of the first fluid and the second fluid. In particular, the controller 200 controls the first flow control device 50 (FIG. 2) to adjust the flow rate of the first fluid to 2.5 oz/sec and the second flow control device 40 (FIG. 2) to adjust the flow rate of the second fluid to 0.5 oz/sec. Thus, the measured fluid ratio is 5:1 and the measured flow rate is 3.0 oz/sec.

Note that a person ordinary skill in the art will recognize that the methods described above with reference to FIGS. 7-8 can be utilized with flow control devices other than needle valves and a manually operated piston flow control. For example, the other electrically operated and controlled flow control devices such as rotary ceramic devices and fixed volume displacement devices can be utilized. Also note in certain examples, the flow control devices 40, 50 are fixed volume displacement devices (e.g., positive displacement pumps) and accordingly, the flow sensors 38, 48 can be excluded from the valve 20. In this example, the controller 200 determines the flow rates of the first fluid and the second fluid based on operating speed of the fixed volume displacement devices.

A person of ordinary skill in the art will appreciate that the methods of the present disclosure are capable of advantageously maintaining the fluid ratio and/or the flow rate of the mixed beverage dispensing via the valve 20 at the desired fluid ratio and/or the desired flow rate set by the technician with minimal future intervention by the technician. The control system 199 (FIG. 6) can further account for variances in the flow rates of the fluids and the fluid characteristics of the fluids and thereby accurately dispense the mixed beverage under a wide range of applications. The variances in the flow rates of the fluids may be attributed to changes in the viscosity and/or density of the fluids as the temperature of the fluids and/or the valve 20 change.

In certain examples, the controller 200 (FIG. 6) is configured to control the first flow control device 50 to thereby minimize or reduce turbulence of the first fluid and/or the second fluid. Turbulence of the fluids occurs with the valve 20 activates and the shutoff valves 60, 70 (FIGS. 4-5) quickly open. To minimize the turbulence in the fluids, the controller 200 (FIG. 6) controls the flow control devices 40, 50 (FIG. 2) to slowly increase the flow rates of the fluids when the shutoff valves 60, 70 open (FIGS. 4-5). An example method for reducing the turbulence of the first fluid is described herein below with reference to FIG. 9. Note that the method described herein below is related to an example valve 20 with a needle valve as the first flow control device 50 (FIG. 2).

Figure 9:
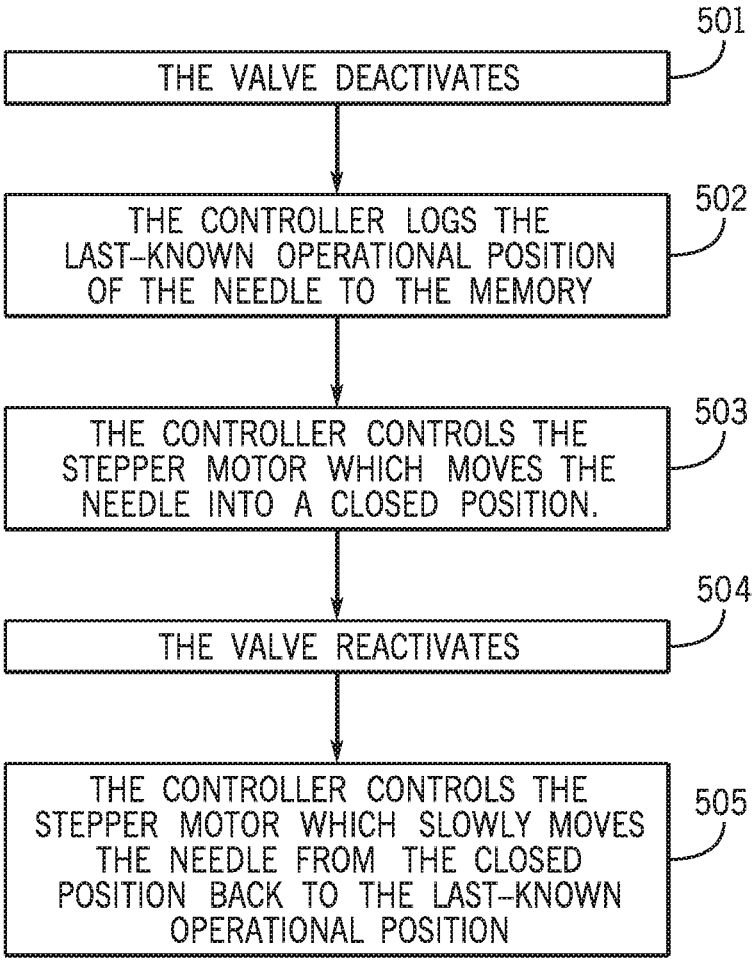
FIG. 9 is another example method of the present disclosure.

The method depicted in FIG. 9 begins when the valve 20 (FIG. 2) deactivates and the shutoff valve 70 (FIG. 5) closes, as depicted at 501 (see also the methods described above with respect to FIGS. 7-8). When the valve 20 deactivates, the controller 200 logs a last-known operational position of the needle 76 (FIG. 5) to the memory 203 of the controller 200 (FIG. 6), as depicted at 502. The last-known operational position corresponds to the position of the needle 76 when the flow rate of the first fluid is the desired flow rate (see above) and the mixed beverage properly dispenses from the valve 20 (as described above the methods related to FIGS. 7-8). In order to minimize turbulence of the first fluid when the valve 20 re-activates and the shutoff valve 70 opens, the controller 200 controls the first flow control device 50 to move the needle 76 into a closed position before the valve 20 re-activates, as depicted at 503. In the closed position, the needle 76 is positioned closer to the valve block 77 than when the needle 76 is in the last-known operational position. That is, in the closed position the distance between the needle 76 and the interior surface (not shown) of the valve block 77 (FIG. 5) is less than the distance between the needle 76 and the interior surface of the valve block 77 when the needle 76 is in the end position (e.g., when the needle 76 is in the closed position, the channel 79 is smaller than when the needle 76 is in the last-known operational position). Thus, when the needle 76 is in the closed position (and if the shutoff valve 60 is open), the flow rate of the first fluid is less than the flow rate of the first fluid when the needle 76 is in the last-known operational position.

As depicted at 504, when the valve 20 re-activates, the shutoff valve 70 opens such that the first fluid begins to flow through the first flow path (FIG. 5). The first fluid initially flows at a reduced flow rate because the needle 76 in is the closed position (noted above). The controller 200 then controls the first flow control device 50 to slowly move the needle 76 (FIG. 5) back to the last-known operational position and thereby slowly increase the flow rate of the first fluid to the desired flow rate necessary to properly form the mixed beverage, as depicted at 505. By slowly moving the needle 76 from the closed position to the last-known operational position, the flow rate of the first fluid slowly increases and the turbulence in the first fluid is minimized because the flow rate does not suddenly and drastically begin flowing at the desired flow rate. Also note that after the controller 200 controls the first flow control device 50 to move the needle 76 from the closed position to the last-known operational position, the controller 200 may further control the first flow control device 50 to further move the needle 76 into a new operational position if the measured flow rate does not equal the desired flow rate (see above example methods described with reference to FIGS. 7-8). Thus, when the valve 20 deactivates, as depicted at 501, the controller 200 would log the new operational position as the last-known operational position, depicted at 502.

A person ordinarily skill in the art will recognize that the method described herein above can be implemented to reduce the turbulence of the second fluid. Furthermore, the method can be implement with other types of flow control devices 50 such as rotary ceramic devices and fixed volume displacement devices. In an example that uses a rotary ceramic device, the controller 200 logs and moves the ceramic discs or interfaces (see below for further description of an example rotary ceramic device) into different positions similar to the positions noted above with respect to the needle valve example described above. In particular, the last-known operational position would be a position in which a first ceramic disc and a second ceramic disc define an orifice through which the first fluid flows at the desired flow rate (see above) and the closed position would be a position in which the first ceramic disc is moved relative to the second ceramic disc such that the orifice is smaller than when the first ceramic disc is in the last-known operational position.

In one example that uses a fixed volume displacement device, the controller 200 would log speed of a rotating component of the fixed volume displacement device that rotates to dispense the first fluid at a flow rate (see below for further description of an example rotary ceramic device) instead of the position of the rotating component. That is, the controller 200 would log a last-known operational speed of the rotating component. The last-known operational speed corresponds to the speed at which the movable component rotates when the first fluid dispenses at the desired flow rate (see above). When the valve 20 re-activates, the controller 200 controls the fixed volume displacement device to slowly increase ("ramp-up") the speed of the rotating component and thereby slowly increase the flow rate of the first fluid to the desired flow rate. Slowly increasing the speed of the rotating component minimizes the turbulence in the first fluid and the first fluid does not suddenly and drastically begin flowing at the desired flow rate.

In certain examples, when the valve 20 deactivates and the shutoff valve 70 (FIG. 5) closes, a volume of the first fluid is retained in the first flow path 31 (FIG. 2) between the first flow control device 50 and the shutoff valve 70 (FIG. 5) (e.g., "a charged volume"). This charged volume remains in the first flow path 31 until the valve 20 activates and the shutoff valve 70 (FIG. 5) opens. In one specific example, the first flow control device 50 is a needle valve. In this example, the needle 76 does not contact the valve block 77 (FIG. 5) when the shutoff valve 70 closes and accordingly, the first fluid passes through the channel 79 of the valve block 77 (FIG. 5) into the first flow channel upstream of the shutoff valve 70 (FIG. 5). When the shutoff valve 70 opens, the charged volume immediately begins to flow (e.g., under force of gravity) past the shutoff valve 70 and toward the nozzle 23 (FIG. 5). As such, the operator observes the charged volume dispensing into the cup 15 in a very short amount of time after the valve 20 activates and the shutoff valve 70 opens. Thus, the operator will understand that the valve 20 is properly operating and will not press harder on the operator input devices 205 (FIG. 6) and/or the lever arm 21 (FIG. 1), as described herein above, because there is minimal time delay between activating the valve 20 and/or opening the shutoff valve 70 (FIG. 5) and actual dispense of the first fluid into the cup 15. Note that features discussed above with respect to the first flow control device 50 (FIG. 2) can be applied to the second flow control device 40. Also note that in some examples, when the solenoid 61 de-energizes the solenoid 61 produces an audible sound (e.g., clicking) thereby providing additional feedback to the user.

Figure 10:
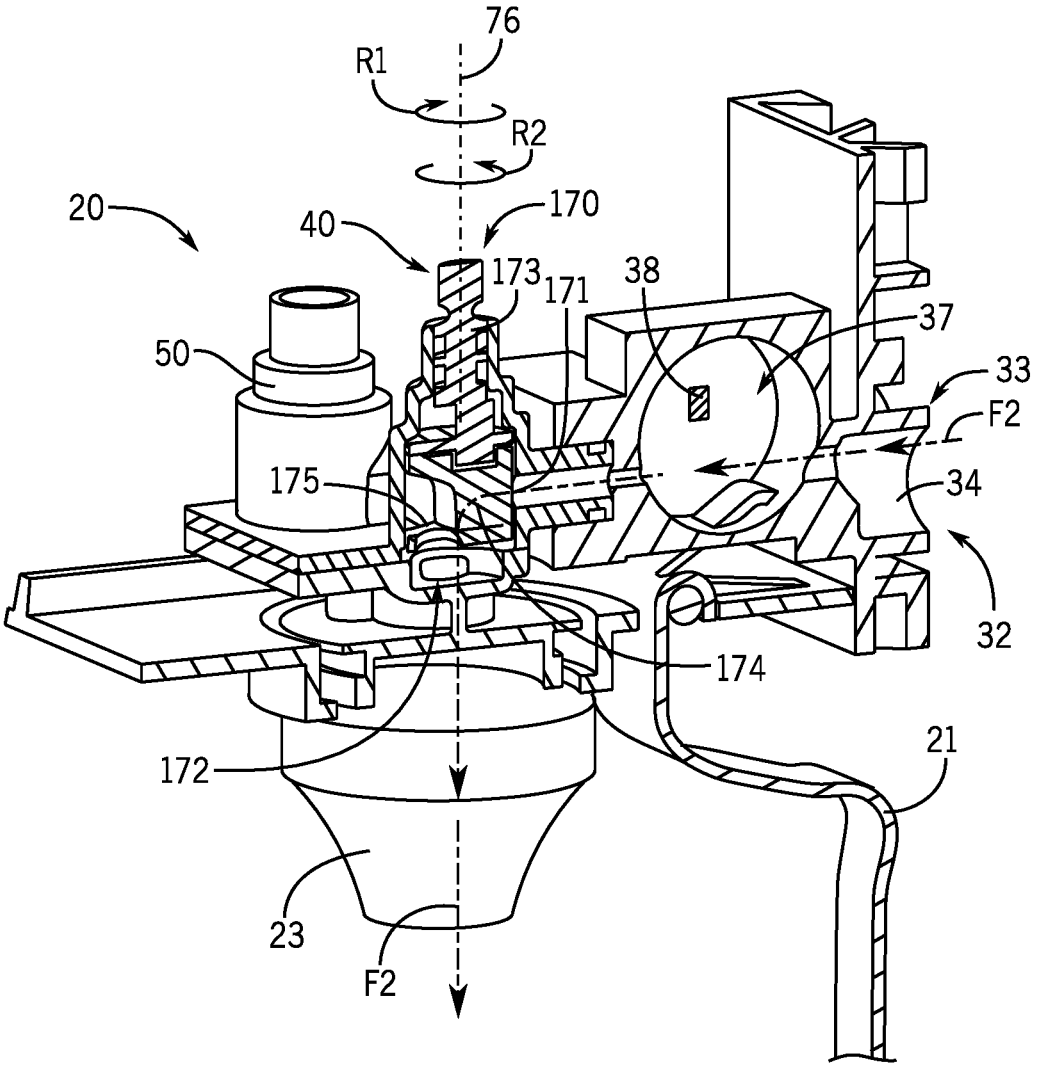
FIG. 10 is a partial cross-sectional view of another example dispensing valve of the present disclosure.

FIG. 10 depicts an example dispensing valve 20 having a rotary ceramic valve 170 as the second flow control device 40. The rotary ceramic valve 170 has an inlet 171 that receives the second fluid (see dashed line F2), an outlet 172 that dispenses the second fluid, and a shaft 173 operably coupled to a first ceramic disc or interface 174. A second ceramic disc or interface 175 has an outlet 172. The second ceramic interface 175 is fixed relative to the first ceramic interface 174. In operation, the shaft 173 is rotated about an axis 176 such that the first ceramic interface 174 moves relative to the second ceramic interface 175 to thereby cover or uncover the outlet 172 (e.g., adjust the size of the outlet 172). For example, when the shaft 173 rotates in a first direction R1 the first ceramic interface 174 rotates in the first direction R1 and covers a portion of the outlet 172. As such, the flow rate of the second fluid through the rotary ceramic valve 170 decreases. When the shaft 173 rotates in the opposite, second direction R2, the first ceramic interface 174 rotates in the second direction R2 and uncovers portions of the outlet 172. As such, the flow rate of the second fluid through the rotary ceramic valve 170 increases. The rotary ceramic valve 170 and rotation of the shaft 173 are controlled by the controller 200 (FIG. 6) via a motor (not shown). An example of a conventional rotary ceramic valve that may be used is manufactured by Kingston Brass (model #KSRTP1000CC).

Figure 11:
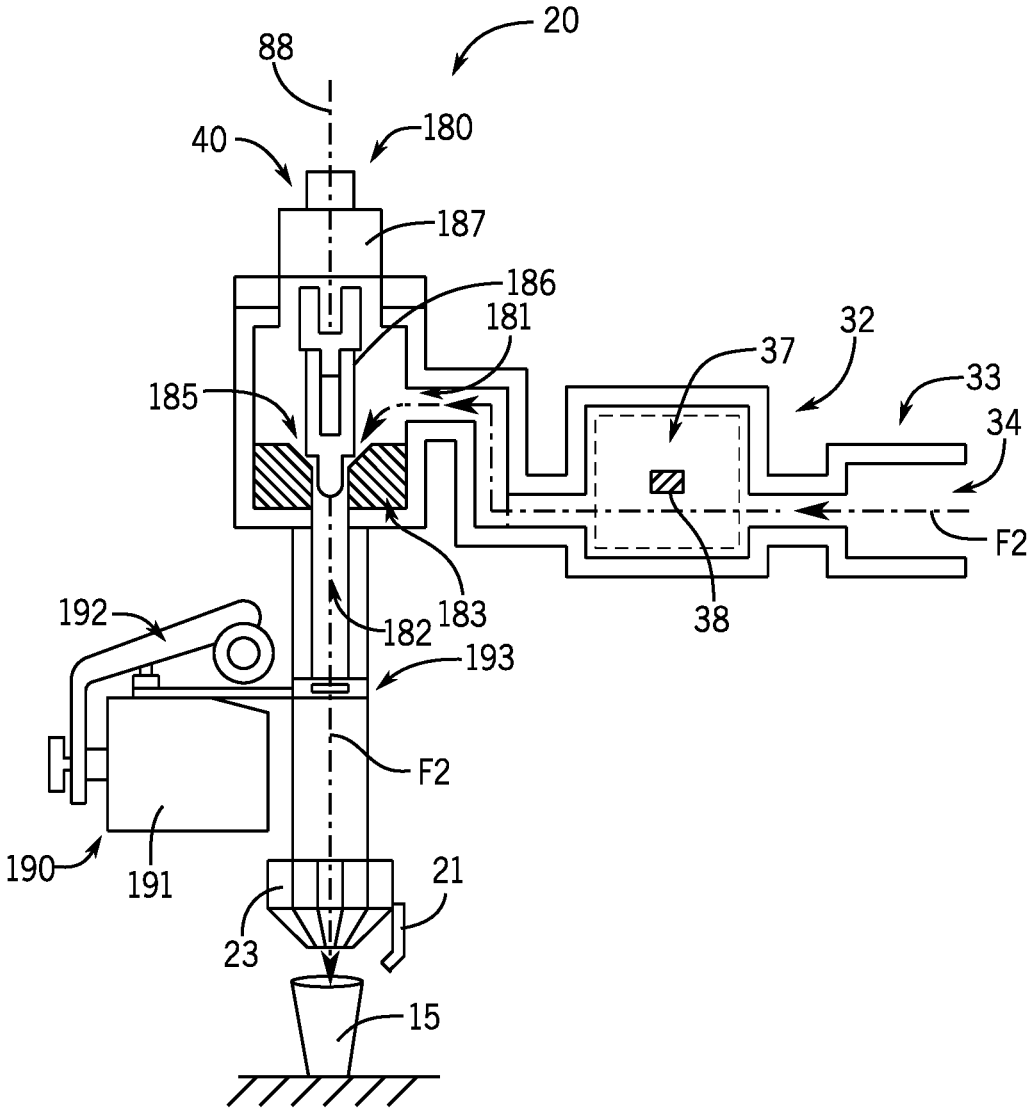
FIG. 11 is a cross-sectional, schematic view of another example dispensing valve of the present disclosure.

FIG. 11 depicts another example dispensing valve 20 having a needle valve 180 as the second flow control device 40. The needle valve 180 has an inlet 181 that receives the second fluid (see dashed line F2) and an outlet 182 that dispenses the second fluid. Immediately upstream of the outlet 182 is a valve block 183 that defines a generally frustoconical-shaped channel 185. A needle 186 is positioned adjacent to the channel 185 and an actuator 187 (e.g., stepper motor) axially moves the needle 186 along an axis 188 toward or away from the channel 185 and an interior surface defining the channel 185. As the needle 186 moves toward the channel 185, the distance between the needle 186 and the valve block 183 decreases, thereby decreasing the space between the needle 186 and the valve block 183 (e.g., the annular space between the needle 186 and the valve block 183 decreases). Accordingly, the amount of the second fluid that can pass through the valve block 183 to the outlet 182 decreases and the flow rate of the second fluid also decreases. As the needle 186 moves away from the channel 185, the distance between the needle 186 and the valve block 183 increases thereby increasing the space between the needle 186 and the valve block 183 (e.g., the annular space between the needle 186 and the valve block 183 increases). Accordingly, the amount of the second fluid that can pass through the valve block 183 to the outlet 182 increases and the flow rate also increases. In certain examples, the needle 186 moves into contact with the valve block 183 to thereby stop flow of the second fluid through the second flow path 32. A shutoff valve 190 positioned downstream of the outlet 182 selectively closes to thereby stop flow of the second fluid. The shut-off valve 190 has a solenoid 191 coupled to an actuating arm 192 and a seal 193 in the second flow path 32. When the solenoid 191 energizes (e.g., by the controller 200 (FIG. 6)), the solenoid 191 pivots the actuating arm 192 in a first direction such that the seal 193 opens and the second fluid flows downstream toward the nozzle 23. When the solenoid 191 de-energizes, the actuating arm 192 pivots in a second direction and the seal 193 closes stopping the flow of the second fluid.

Figure 12:
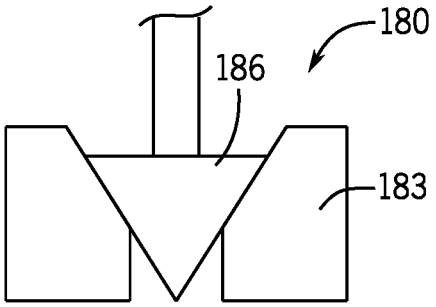
FIGS. 12-14 are partial cross-sectional views of an example needle valve of the present disclosure.
Figure 13:
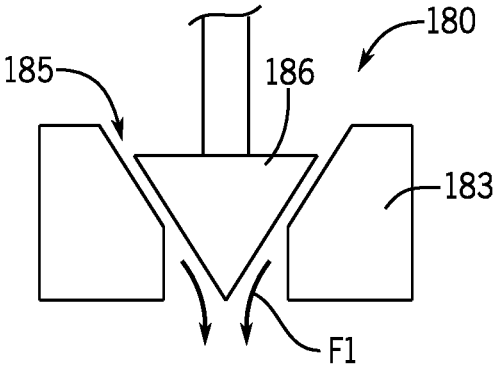
Figure 14:
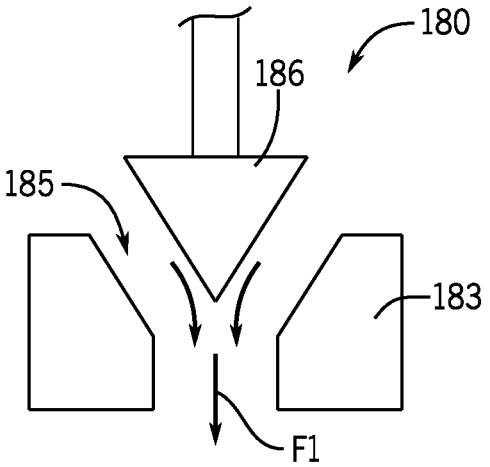

FIGS. 12-14 are enlarged views of an example needle valve 180 of the present disclosure with the needle 186 in different positions relative to valve block 183. Specifically, FIG. 12 depicts the needle 186 in a fully-closed position in which the needle 186 contacts the valve block 183. Thus, the first fluid does not flow through the needle valve 180 and the first flow path 31 (FIG. 5). FIG. 13 depicts the needle 186 in an intermediate position in which the needle 186 is spaced apart from the valve block 183 (the intermediate position depicted in FIG. 13 may be similar to the "closed position" described above with respect to the method depicted in FIG. 9). The needle 186 can be slowly moved into the intermediate position so that the first fluid (see arrow F1) begins to slowly or gradually flow through the channel 185. FIG. 14 depicts the needle 186 in an open position in which the first fluid flows through the needle valve 180 at a desired flow rate through the channel 185 and the first flow path 31 (FIG. 5) (the open position depicted in FIG. 13 may be similar to the "last-known operational position" described above with respect to the methods depicted in FIG. 9). During operation of the valve 20, the controller 200 (FIG. 6) controls the actuator 72 (FIG. 5) to thereby move the needle 186 into and between the positions depicted in FIGS. 12-14. The controller 200 is further capable of controlling the actuator 72 (and thereby the needle 186) to slowly or gradually move the needle 186 into any position (e.g., the intermediate position depicted in FIG. 11) to thereby minimize turbulence of the first fluid as the first fluid flows through the needle valve 180.

Figure 15:
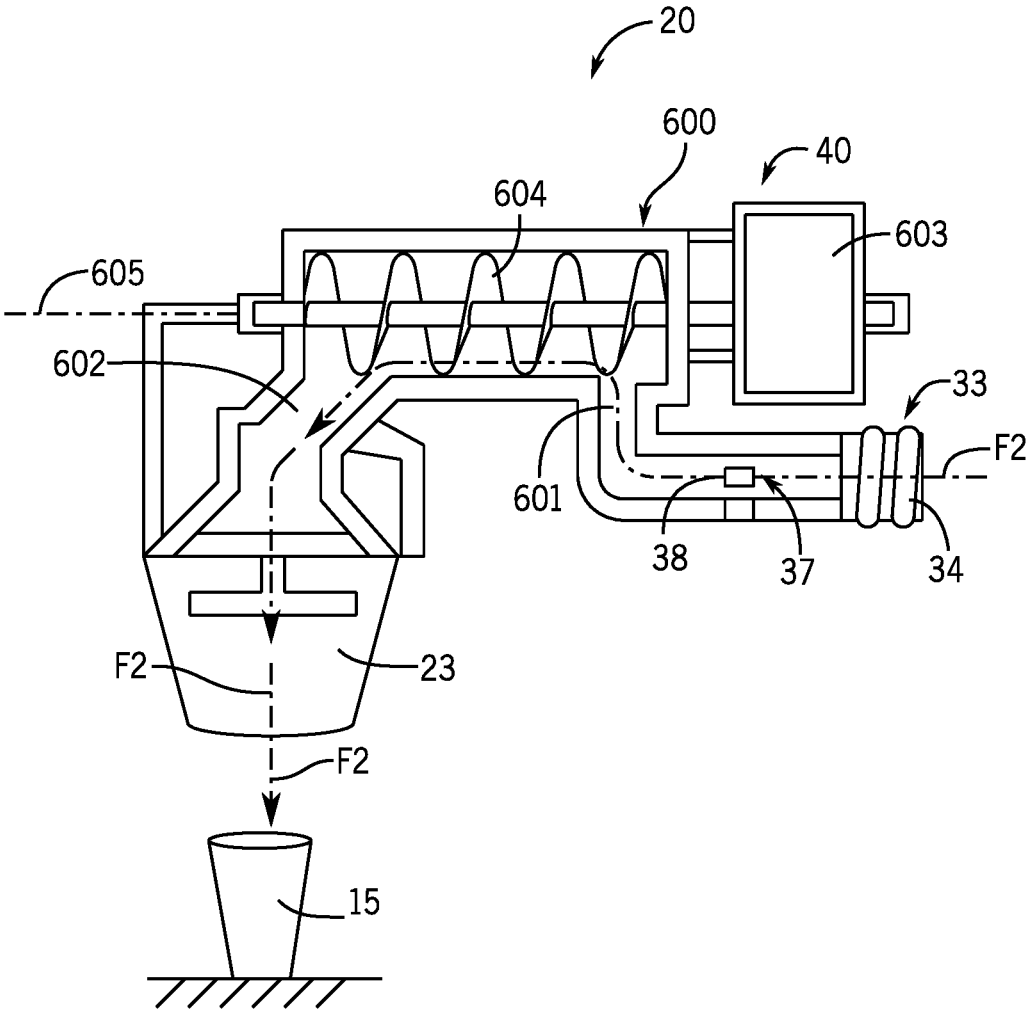
FIG. 15 is a cross-sectional, schematic view of another example dispensing valve of the present disclosure.

FIG. 15 depicts a cross-sectional view of an example dispensing valve 20 in which the second flow control device 40 is a fixed volume displacement device 600, such fixed volume displacement pump. The device 600 has an inlet 601 that receives the second fluid (see dashed line F2) and an outlet 602 that dispenses the second fluid. The device 600 has a motor 603 operably connected to a dispensing member 604. The motor 603 is connected to the controller 200 (FIG. 6), and when the motor 603 energizes the dispensing member 604 rotates about an axis 605 and the second fluid dispenses through the outlet 602. When the motor 603 de-energizes, the rotation of the dispensing member 604 stops and the second fluid does not dispense through the outlet 602. As described in the other examples noted above, the flow sensor 38 can sense the flow rate of the second fluid and generate sensor data. The controller 200 (FIG. 6) receives the sensor data and further processes the sensor data. Based on the sensed flow rate of the second fluid the controller 200 controls and can thereby varies the speed of the motor 603 to thereby change the flow rate of the second fluid to match the predetermined flow rate. In other examples, the flow sensor 38 is excluded and the controller 200 (FIG. 6) determines the flow rate of the second fluid based on the speed of the motor 603. This determination is possible because the speed of the motor 603 relates to known rotation of the dispensing member 604 such that the flow rate is also known.

In one example, the piston flow control includes a piston and sleeve within a chamber that is in fluid communication with the fluid in the flow path. The piston is slideably positioned within the sleeve, and the piston is biased by a spring against the flow the fluid through the flow control. The piston has a hole through which the fluid flows, and the sleeve has one or more holes extending there through. In operation, the pressure of the fluid compresses the spring and moves the piston such that the piston covers portions of the holes in the sleeve. The degree to which the piston covers the holes as the piston moves against the spring determines the flow rate of the fluid through the flow control and out of an outlet of the flow control.

In certain examples, a beverage dispensing machine includes a dispensing valve having a first flow path configured to dispense a first fluid and a second flow path configured to dispense a second fluid such that the first fluid and the second fluid mix downstream and form a mixed beverage. A flow control device regulates flow rate of the first fluid through the first flow path, and a shutoff valve selectively closes to stop flow of the first fluid through the first flow path. A sensor is configured to sense the flow rate of the first fluid, and a controller automatically controls the flow control device to adjust the flow rate of the first fluid and thereby obtain a desired fluid ratio of the mixed beverage.

In certain examples, the shutoff valve is downstream from the flow control device. In certain examples, when the shutoff valve closes, the first fluid is retained between the shutoff valve and the flow control device. In certain examples, the sensor is a first sensor and a second sensor is configured to sense flow rate of the second fluid. The controller controls the flow control device based on the sensed flow rate of the first fluid and a sensed flow rate of the second fluid. In certain examples, the flow control device is a needle valve having a needle movable within the first flow path relative to a valve block to thereby vary distance between the needle and the valve block and regulate the flow rate of the first fluid through the first flow path. In certain examples, when the shutoff valve closes, the needle is spaced apart from the valve block. In certain examples, a piston flow control regulates a flow rate of the second fluid through the second flow path, and the shutoff valve selectively closes to stop flow of the second fluid through the second flow path.

In certain examples, the piston flow control is manually adjustable to thereby adjust the flow rate of the second fluid. In certain examples, a second sensor is configured to sense the flow rate of the second fluid, and the controller controls the needle valve based on a sensed flow rate of the first fluid and a sensed flow rate of the second fluid. In certain examples, the flow control device is a first needle valve and the machine has a second needle valve that regulates flow rate of the second fluid through the second flow path and a second sensor configured to sense a flow rate of the second fluid. The controller controls the first needle valve and the second needle valve based on the sensed flow rate of the first fluid and a sensed flow rate of the second fluid.

In certain examples, a beverage dispensing system has a dispensing valve with a first flow path configured to dispense a first fluid and a second flow path configured to dispense a second fluid such that the first fluid and the second fluid mix downstream to form the mixed beverage. A first flow control device is configured to regulate flow rate of the first fluid, and a second flow control device is configured to regulate flow rate of the second fluid. A first sensor is configured to sense the flow rate of the first fluid and generate sensor data and a second sensor is configured to sense the flow rate of the second fluid and generate sensor data. A pair of shutoff valves selectively close to stop flow of the first fluid through the first flow path and the second fluid through the second flow path. A controller receives the sensor data from the first sensor and the second sensor, determines a sensed flow rate of the first fluid and a sensed flow rate of the second fluid, further determines a measured fluid ratio of the mixed beverage based on the sensed flow rate of the first fluid and the sensed flow rate of the second fluid, and compares the measured fluid ratio to a desired fluid ratio, wherein the controller further controls the flow control device to thereby change the flow rate of the first fluid and the flow rate of the second fluid such that the measured fluid ratio equals the desired fluid ratio.

In certain examples, the shutoff valves are downstream from the first and the second flow control devices. When the pair of shutoff valves closes, the first fluid is retained between one of the pair of shutoff valves and the first flow control device and the second fluid is retained between the other of the pair of the shutoff valves and the second flow control device. In certain examples, the first flow control device is a needle valve having a needle movable within the first flow path relative to a valve block to thereby vary distance between the needle and the valve block and regulate the flow rate of the first fluid through the first flow path. In certain examples, the second flow control device is a ceramic piston flow control that regulates a flow rate of the second fluid through the second flow path. In certain examples, the needle valve is a first needle valve, and wherein the second flow control device is a second needle valve.

In certain examples, a method for dispensing a beverage from a beverage dispensing machine, the method includes dispensing a first fluid from a first flow path and a second fluid from a second flow path to thereby form a mixed beverage, regulating, with a flow control device, flow rate of the first fluid through the first flow path, selectively closing a shutoff valve to thereby stop dispense of the first fluid from the first flow path, sensing the flow rate of the first fluid through the first flow path with a first sensor that generates sensor data, determining a sensed flow rate of the first fluid based on the sensor data from the first sensor, determining a measured fluid ratio based on the sensed flow rate of the first fluid, comparing the measured fluid ratio to a desired fluid ratio, and controlling the flow control device to thereby change the flow rate of the first fluid such that the measured fluid ratio matches the desired fluid ratio.

In certain examples, the shutoff valve is downstream from the flow control device and when the shutoff valve is closed, the first fluid is retained between the flow control device and the shutoff device.

In certain examples, the method includes sensing the flow rate of the second fluid through the second flow path with a second sensor that generates sensor data, determining a sensed flow rate of the second fluid based on the sensor data from the second sensor, determining the measured fluid ratio based on the sensed flow rate of the first fluid and the sensed flow rate of the second fluid, comparing the measured fluid ratio to a desired fluid ratio, and controlling the one or both of the first flow control device and the second flow control devices to thereby change the flow rate of the first fluid and the flow rate of the second fluid such that the measured fluid ratio matches the desired fluid ratio.

In certain examples, a method for dispensing a beverage from a beverage dispensing machine includes dispensing a first fluid from a first flow path and a second fluid from a second flow path to thereby form a mixed beverage, closing a shutoff valve to stop the flow of the first fluid, operating a flow control device while the shutoff valve is closed such that when the shutoff valve opens, the first fluid flow through the first flow path at a first flow rate, opening the shutoff valve such that the first fluid flows at the first flow rate, and operating the flow control device to slowly increase the flow rate of the first fluid from the first flow rate to a second flow rate that is greater than the first flow rate. In certain examples, the flow control device is a needle valve with a needle that is movable to thereby adjust the flow rate of the first fluid.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A beverage dispensing machine comprising:

a dispensing valve having a first flow path configured to dispense a first fluid and a second flow path configured to dispense a second fluid such that the first fluid and the second fluid mix downstream and form a mixed beverage;

a first flow control device that regulates flow of the first fluid through the first flow path;

a shutoff valve that selectively opens and selectively closes to permit or occlude flow of the first fluid through the first flow path;

a first sensor configured to sense a first flow rate of the first fluid;

a second sensor configured to sense a second flow rate of the second fluid; and a controller that receives the first flow rate and the second flow rate and automatically controls a first operational position of the first flow control device to adjust the flow of the first fluid based upon the first flow rate and the second flow rate, and thereby dispenses the mixed beverage at a predetermined fluid ratio between the first fluid and the second fluid, wherein the controller retains the first operational position of the first flow control device while the shutoff valve is selectively closed;

wherein when the shutoff valve selectively closes, the controller controls the first flow control device to a second operational position configured to achieve a flow rate of the first fluid below the first flow rate, and when the shutoff valve selectively opens, the controller controls the first flow control device to open from the second operational position to the first operational position.

2. The beverage dispensing machine according to claim 1, wherein the shutoff valve is downstream from the first flow control device, wherein when the shutoff valve selectively closes, the first fluid is retained in the first flow path between the shutoff valve and the first flow control device.

3. The beverage dispensing machine according to claim 1, wherein the controller further:

calculates a current fluid ratio of the mixed beverage from the received first flow rate and the second flow rate;

compares the calculated current fluid ratio to the predetermined target fluid ratio for the mixed beverage; and adjusts the flow of the first fluid through the flow control device to achieve the predetermined fluid ratio.

4. The beverage dispensing machine according to claim 3, wherein the first flow control device is a first needle valve having a first needle movable within the first flow path relative to a first valve block to the first operational position in which the flow of the first fluid through the first flow control device achieves the predetermined fluid ratio.

5. The beverage dispensing machine according to claim 4, further comprising a piston flow control that regulates the second flow rate of the second fluid through the second flow path, and wherein the shutoff valve selectively closes to stop flow of the second fluid through the second flow path, wherein the piston flow control is manually adjustable to thereby adjust the second flow rate of the second fluid.

6. The beverage dispensing machine according to claim 4, wherein when the shutoff valve selectively closes, the controller moves the first needle relative to the first valve block to a second operational position, and wherein when the shutoff valve subsequently selectively opens, the controller moves the first needle relative to the first valve block from the second operational position to the first operational position to increase the flow of the first fluid through the first flow control device.

7. The beverage dispensing machine according to claim 1, wherein the first flow control device is a first needle valve, and further comprising:

a second needle valve that regulates flow rate of the second fluid through the second flow path; and wherein the controller controls the first needle valve and the second needle valve based on the sensed flow rate of the first fluid and a sensed flow rate of the second fluid.

8. The beverage dispensing machine according to claim 1, wherein the shutoff valve comprises a first shutoff valve that selectively closes to stop flow of the first fluid through the first flow path and a second shutoff valve that selectively closes to stop the flow of the second fluid through the second flow path.

* * * * *